US005850821A

United States Patent [19]

Curtis

[11] Patent Number: 5,850,821

[45] Date of Patent: Dec. 22, 1998

[54] METHOD AND SYSTEM FOR ESTIMATING AIR/FUEL RATIO OF AN ENGINE HAVING A NON-HEATED FUEL VAPORIZER

[75] Inventor: Eric Warren Curtis, Ann Arbor, Mich.

[73] Assignee: Ford Global Technologies, Inc., Dearborn, Mich.

[21] Appl. No.: 842,107

[22] Filed: Apr. 28, 1997

[51] Int. Cl.[6] ..... F02M 17/00

[52] U.S. Cl. ..... 123/524; 123/522; 123/523; 123/549

[58] Field of Search ..... 123/179.15, 523, 123/524, 527, 549, 522

[56] References Cited

U.S. PATENT DOCUMENTS

| | | | |
|---|---|---|---|
| 4,290,401 | 9/1981 | Pedersen | 123/437 |
| 4,372,280 | 2/1983 | Adams | 123/522 |
| 4,848,302 | 7/1989 | Firey | 123/523 |
| 5,465,701 | 11/1995 | Hunt | 123/179.15 |
| 5,711,282 | 1/1998 | Lang et al. | 123/514 |
| 5,722,588 | 3/1998 | Inoue et al. | 431/37 |

*Primary Examiner*—Henry C. Yuen
*Assistant Examiner*—Hai Huynh
*Attorney, Agent, or Firm*—Allan J. Lippa; Roger L. May

[57] ABSTRACT

A method and system for estimating air/fuel ratio of an internal combustion engine having a fuel vaporizer device calculates the rate of fuel evaporation based on temperature of the vaporizer device to estimate air/fuel ratio during a cold-start. In one embodiment, a temperature of the fuel vaporizer device is determined directly by an appropriate sensor. In another embodiment, the temperature is determined using a transient heat transfer model based on the air flow rate through the device and the exit temperature of the air/fuel mixture. The temperature is used to determine the amount of energy entering the fuel vaporizer device as well as the amount of energy leaving the fuel vaporizer device so as to determine the amount of fuel vaporized by the fuel vaporizer device. The air/fuel ratio is then estimated based on the amount of fuel vaporized.

14 Claims, 3 Drawing Sheets

METHOD AND SYSTEM FOR ESTIMATING AIR/FUEL RATIO OF AN ENGINE HAVING A NON-HEATED FUEL VAPORIZER

TECHNICAL FIELD

This invention relates to methods and systems for estimating air/fuel ratio of an internal combustion engine having a non-heated fuel vaporizer device.

BACKGROUND ART

Control of regulated emissions during the first several seconds after a cold engine start is difficult for several reasons. Because the catalytic converter has not reached operating temperature, the catalyst does not efficiently convert emissions. Furthermore, the exhaust gas oxygen (EGO) sensor does not provide a feedback signal to enable closed-loop control of the air/fuel ratio during this period. Since there is no feedback sensor operational yet, the engine is operating in an "open loop" mode. Once the EGO sensor is warmed up, the engine operates in a "closed loop" mode in which the air/fuel ratio can be controlled because the sensor can now correct any errors in the air/fuel ratio.

In an engine having a fuel vaporizer device, the fuel vaporizer device is utilized to assist the engine during cold-start operation. The vaporization of the air/fuel mixture of the device results in a warm or heated mixture being applied to the combustion chambers of the engine. Thus, there exists a need to estimate air/fuel ratio during cold-start engine operation so that the delivery of fuel to the vaporizer device can be controlled accordingly.

DISCLOSURE OF THE INVENTION

It is thus a general object of the present invention to provide a method and system for estimating air/fuel ratio of an internal combustion engine having a fuel vaporizer device during cold-start engine operation to emulate closed-loop control.

It is an advantage of the present invention to eliminate intake port wall-wetting caused by fuel and excess fuel enrichment required for cold-start engine operation utilizing a fuel vaporizer device.

In carrying out the above objects and other objects, features, and advantages of the present invention, a method is provided for estimating air/fuel ratio of an internal combustion engine having a non-heated fuel vaporizer device. The method includes the step of determining a mass rate of air entering and leaving the fuel vaporizer device. The method also includes the step of determining a mass rate of fuel vaporized by the fuel vaporizer device based on the mass rate of air entering and leaving the fuel vaporizer device. Finally, the method includes the step of estimating the air/fuel ratio based on the mass rate of fuel vaporized by the fuel vaporizer device.

In further carrying out the above object and other objects, features, and advantages of the present invention, a system is also provided for carrying out the steps of the above described method.

The above object and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
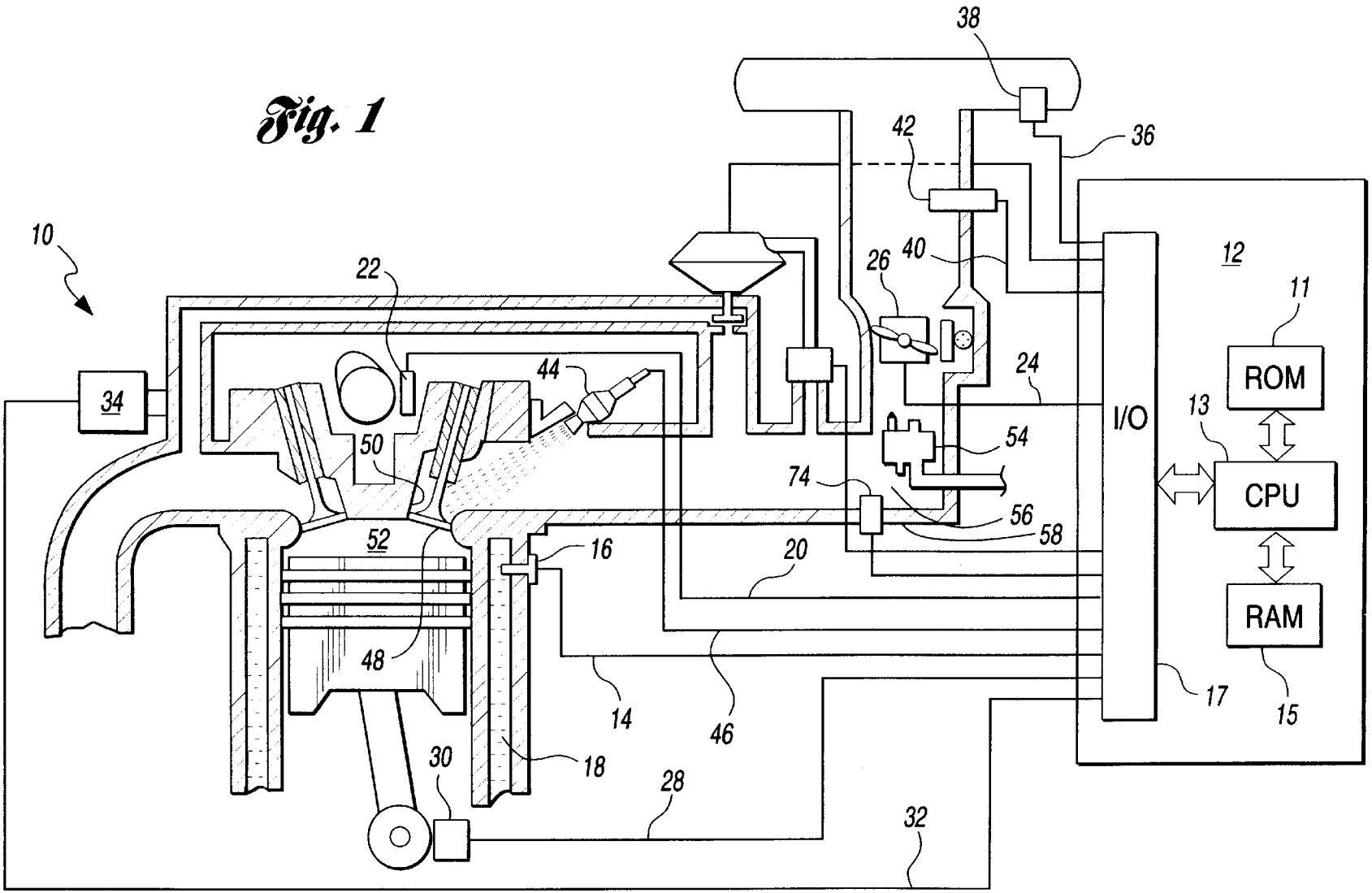
FIG. 1 is a schematic diagram of the preferred embodiment of the system of the present invention.

Turning now to FIG. 1, there is shown an internal combustion engine which incorporates the teachings of the present invention. The internal combustion engine 10 comprises a plurality of combustion chambers, or cylinders, one of which is shown in FIG. 1. The engine 10 is controlled by an Electronic Control Unit (ECU) 12 having various computer readable storage media, such as a Read Only Memory (ROM) 11 and a Random Access Memory (RAM) 15 in communication with a Central Processing Unit (CPU) 13. The ECU 12 receives a plurality of signals from the engine 10 via an Input/Output (I/O) port 17, including, but not limited to, an Engine Coolant Temperature (ECT) signal 14 from an engine coolant temperature sensor 16 which is exposed to engine coolant circulating through coolant sleeve 18, a Cylinder Identification (CID) signal 20 from a CID sensor 22, a throttle position signal 24 generated by a throttle position sensor 26, a Profile Ignition Pickup (PIP) signal 28 generated by a PIP sensor 30, an Exhaust Gas Oxygen (EGO) signal 32 from a EGO sensor 34, an air intake temperature signal 36 from an air temperature sensor 38, and an air flow signal 40 from an air flow meter 42. The ECU 12 includes control logic for processing these signals to control the engine accordingly. For example, ECU 12 processes the signals received from the engine 10 and generates a fuel injector pulse waveform transmitted to the fuel injector 44 on signal line 46 to control the amount of fuel delivered by the fuel injector 44. Intake valve 48 operates to open and close intake port 50 to control the entry of an air/fuel mixture into combustion chamber 52.

The engine 10 further includes a non-heated vaporizer device 54 positioned between throttle position sensor 26 and a plenum 56 of an intake manifold 58. An outlet sensor 74 is positioned downstream of the vaporizer device for sensing the temperature of the air/vapor mixture leaving vaporizer device 54. The vaporizer device 54 is shown in greater detail in FIG. 2. Vaporizer device 54 includes a vaporizer fuel injector 60, an air inlet 62, an air/vapor mixture outlet 64, a housing shell 66 and a fuel outlet 68. The vaporizer fuel injector 60 is positioned on top of vaporizer device 54 to inject fuel into a porous evaporating tube 70. The exterior of the porous tube 70 is open to a large interior volume of the housing shell 66.

Air from intake manifold 58 enters vaporizer device 54 via air inlet 62. The air mixes with the fuel injected by vaporizer fuel injector 60 to form an air/vapor mixture inside the housing shell 66. The air/vapor mixture exits vaporizer device 54 via air/vapor mixture outlet 64 into the plenum 56 of intake manifold 58 so that all of the air/vapor mixture goes to all of the combustion chambers 52. Unvaporized fuel exits vaporizer device 54 via fuel outlet 68 which is either connected to a pump (not shown) which would return the unvaporized fuel to the fuel tank (not shown) or connected directly to a fuel rail (not shown).

The vaporizer device 54 is a part-time fuel charging device designed to generate a uniform air/vapor mixture for engine cold starting and warm-up idling of a spark-ignited (S.I.) engine. The vaporizer device 54 utilizes manifold vacuum to generate an air/vapor mixture. Its design intent is the elimination of intake port wall-wetting by fuel and the excess fuel enrichment required for cold starting. Once the engine is sufficiently warm or a significant load is applied (reducing the vapor generating potential), the vaporizer device 54 is gradually disabled. While being disabled, the conventional port injectors are then activated, making up the difference in the fueling requirements. After the transition, the port injectors become the only fuel charging source. The porous vaporizer device 54 requires no added heat energy to evaporate fuel. Heat energy for vaporization is obtained from ambient temperature.

The present invention utilizes a transient heat transfer model to estimate fuel evaporation rate and cold start air/fuel ratio so as to allow instantaneous closed loop operation. The engine can then operate in a closed loop mode utilizing the vaporizer device 54 and a heat transfer model until the EGO sensor 34 is operational. The heat transfer model requires only two temperatures, the air inlet temperature and the air outlet temperature, which can be inexpensively measured using currently available techniques.

The heat transfer model is based on the conservation of energy (i.e., the first law of thermodynamics). The change in energy of the system=(energy entering vaporizer device 54)−(energy leaving vaporizer device 54). The equation relates the change in energy to the enthalpy, which is a function of temperature and the amount of fuel vaporized. Therefore, only two temperatures are needed with a transient heat transfer model in order to estimate the amount of fuel vaporized and the air/fuel ratio.

The heat transfer model of the system is illustrated in the following equation:

$$\left(mCp\frac{dT}{dt}\right)_{structure} = (\dot{m}_{air}h_{air} + \dot{m}_{fuel}h_{fuel})_{in} - (\dot{m}_{air}h_{air} + \dot{m}_{fuel\text{-}vaporized}h_{fuel\text{-}vaporized})_{out} - (\dot{m}_{fuel\text{-}unvaporized}h_{fuel\text{-}unvaporized}) \quad (1)$$

where, $$\left(mCp\frac{dT}{dt}\right)_{structure}$$

represents the change in energy of the system, m is the mass of vaporizer device 54, and Cp is the specific heat of vaporizer device 54;

$\dot{m}_{air}$ into vaporizer device 54 represents the mass flow rate of air as sensed by air flow meter 42;

$h_{air}$ into vaporizer device 54 represents the enthalpy of air, which is located in a look-up table indexed by the temperature of the air as sensed by air temperature sensor 38;

$\dot{m}_{fuel}$ into vaporizer device 54 represents the mass rate of fuel injected by vaporizer fuel injector 60 as directed by ECU 12 and is equal to $\dot{m}_{fuel\text{-}unvaporized}+\dot{m}_{fuel\text{-}vaporized}$;

$h_{fuel}$ into vaporizer device 54 represents the enthalpy of the injected fuel which is located in a look-up table indexed by the temperature of the fuel. The fuel temperature can be either sensed directly or estimated from the engine coolant temperature sensor 16;

$\dot{m}_{air}$ out of vaporizer device 54 represents the mass rate of air out of the vaporizer device 54 and is equal to the mass flow rate of air into the vaporizer device 54 as sensed by air flow meter 42;

$h_{air}$ out of vaporizer device 54 represents the enthalpy of the air which is located in a look-up table indexed by the temperature of the air as sensed by outlet sensor 74;

$\dot{m}_{fuel\text{-}vaporized}$ represents the mass rate of vaporized fuel that is solved for simultaneously with the mass of unvaporized fuel;

$h_{fuel\text{-}vaporized}$ represents the enthalpy of the vaporized fuel which is located in a look-up table indexed by the temperature of the fuel as described above;

$\dot{m}_{fuel\text{-}unvaporized}$ represents the mass rate of unvaporized fuel that is solved for simultaneously with the mass of vaporized fuel; and $h_{fuel\text{-}unvaporized}$ represents the enthalpy of the unvaporized fuel which is located in a look-up table indexed by the temperature of the fuel as described above.

Since the mass rate of the fuel into the fuel vaporizer device 54 is known and is equal to the sum of the mass rate of fuel unvaporized and the mass rate of fuel vaporized, the $\dot{m}_{fuel\text{-}unvaporized}$ in Equation #1 can be substituted with ($\dot{m}_{fuel}-\dot{m}_{fuel\text{-}vaporized}$). Similarly, $\dot{m}_{air}$ out of vaporizer device 54 in Equation #1 can be replaced by $[(\dot{m}_{air})_{in}]$.

If the inlet mass air flow is measured as well as the inlet temperature of the air and fuel and the outlet temperature of the air, and the above-described substitutions are made, then the only unknowns are the temperature of the vaporizer device 54, and the mass of vaporized fuel, as follows:

$$\left(mCp\frac{dT}{dt}\right)_{structure} = (\dot{m}_{air}h_{air} + \dot{m}_{fuel}h_{fuel})_{in} - [(\dot{m}_{air})_{in}(h_{air})_{out} + (\dot{m}_{fuel\text{-}vaporized})_{out}(h_{fuel\text{-}vaporized})_{out}] - \{[(\dot{m}_{fuel})_{in} - (\dot{m}_{fuel\text{-}vaporized})_{out}]h_{fuel\text{-}unvaporized}\} \quad (2)$$

Figure 2:
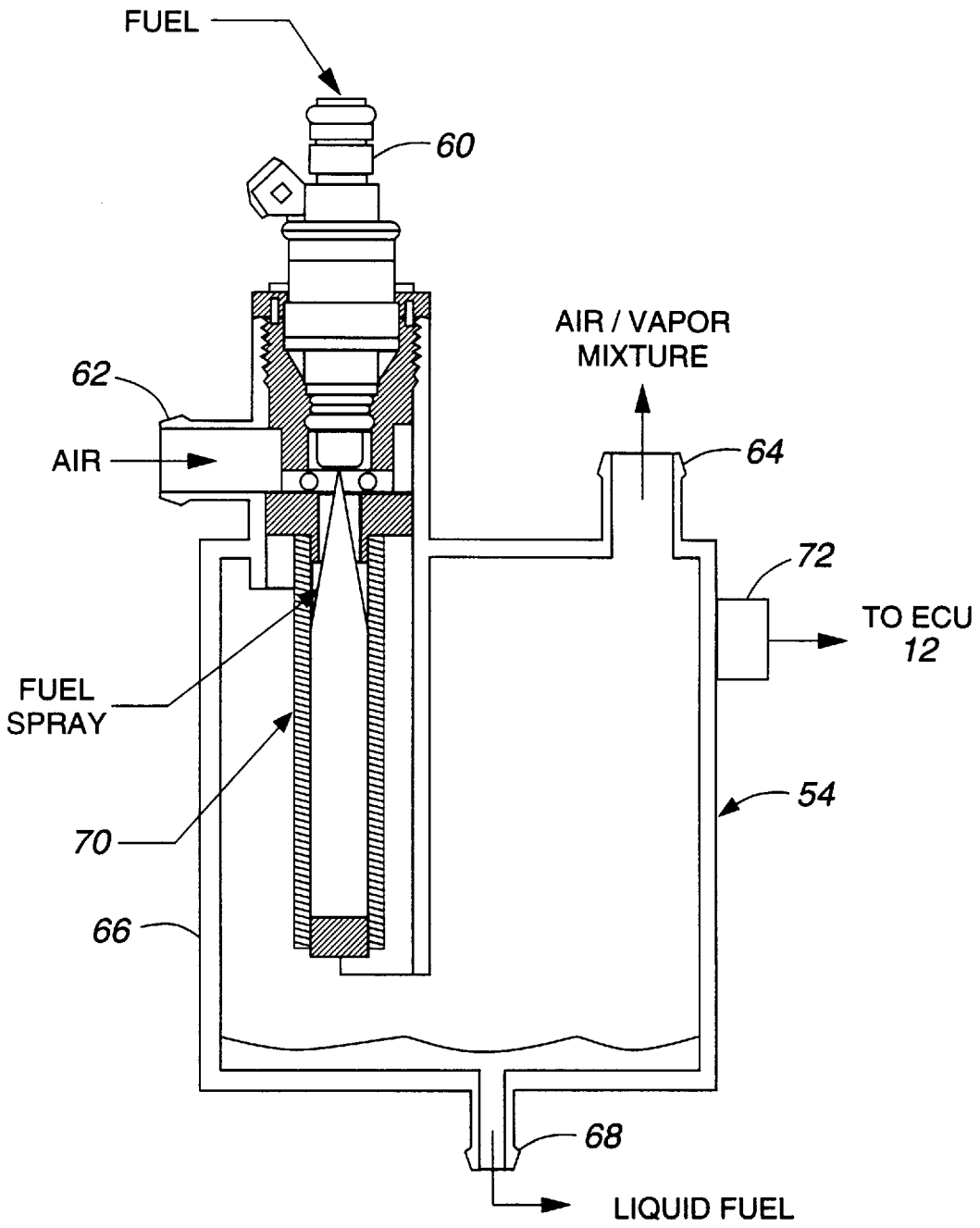
FIG. 2 is cross-sectional view of a vaporizer device utilized in the present invention.

Two different approaches can be used as described below in determining the temperature of the vaporizer device 54. If a sensor 72 (as shown in FIG. 2) is used to measure the temperature of vaporizer device 54, then the above equation can be used to directly solve for the mass of vaporized fuel.

If the temperature of vaporizer device 54 is not directly measured, then a transient heat transfer model of the device 54 can be used to estimate the temperature as a function of the air flow rate and the outlet temperature. A simple example of a transient heat transfer model for the device 54 is as follows:

$$\left(mCp\frac{dT}{dt}\right)_{structure} = [T_{structure} - T_{air\text{-}out}]\cdot A_s\cdot h(Re) \quad (3)$$

where, $T_{structure}$ is an estimate of the initial temperature of device 54 which can be represented as either ambient temperature or engine coolant temperature as sensed by engine coolant temperature sensor 16;

$T_{air\text{-}out}$ is the temperature of the air as sensed by outlet sensor 74;

$A_s$ is the internal surface area of vaporizer device 54; and h(Re) is the convection coefficient as a function of the Reynolds number, which is a function of the mass flow rate of the air.

Once the mass of the vaporized fuel is determined using Equations (2) and (3), the air/fuel can then be estimated according to the following equation:

$$\text{Air/Fuel Ratio} = \frac{(m_{air})_{in}}{m_{fuel\text{-}vaporized}} \quad (4)$$

where, $m_{air}$ into vaporizer device 54 is as described above, and $m_{fuel\text{-}vaporized}$ is as described above.

Figure 3:
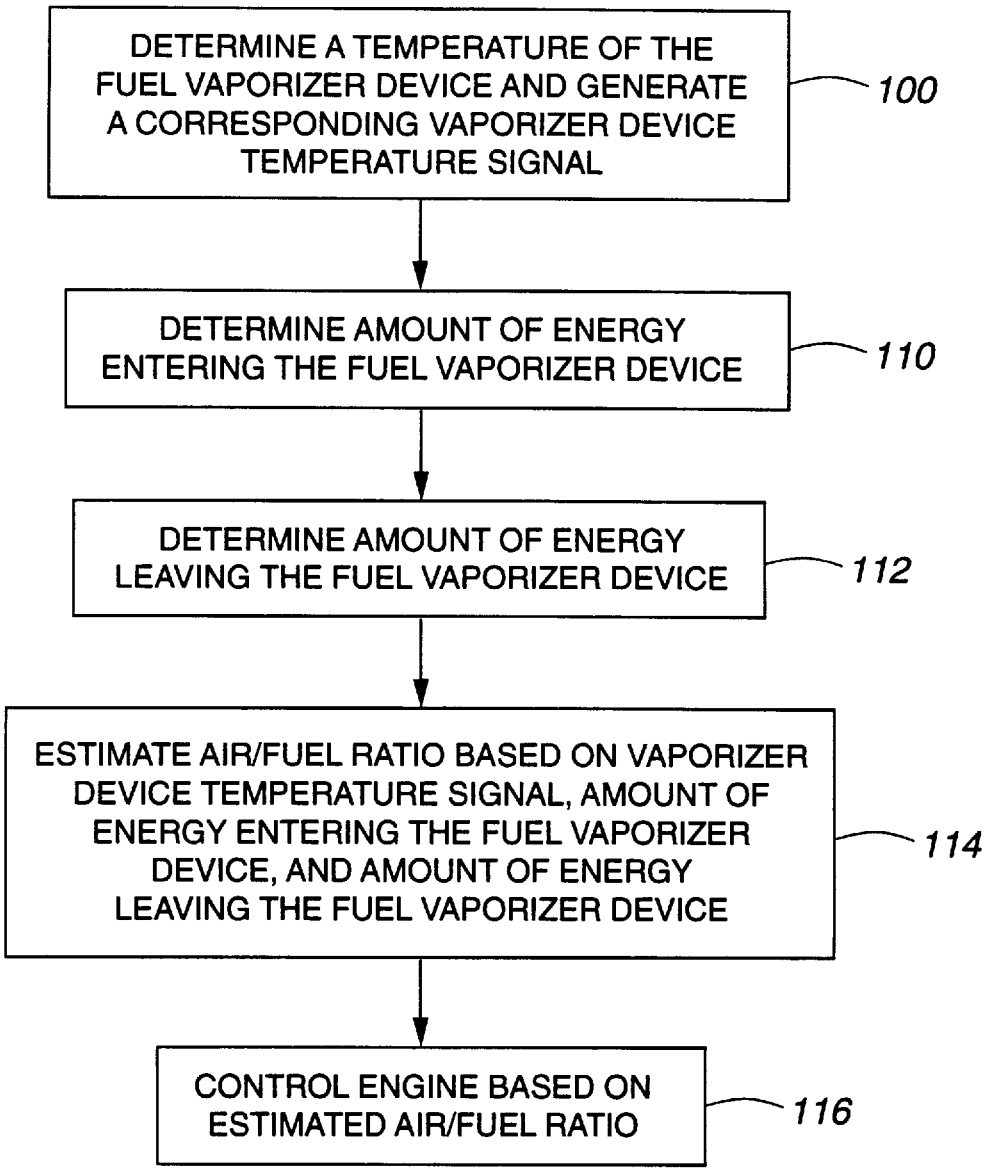
FIG. 3 is a flow diagram illustrating the general sequence of steps associated with the operation of the present invention.

Turning now to FIG. 3, there is shown a flow diagram illustrating the general sequence of steps associated with the operation of the present invention, as performed by control logic, or ECU 12. Although the steps shown in FIG. 3 are depicted sequentially, they can be implemented utilizing interrupt-driven programming strategies, object-oriented programming, or the like. In a preferred embodiment, the steps shown in FIG. 3 comprise a portion of a larger routine which performs other engine control functions.

The method begins with the step of determining a temperature of a fuel vaporizer device and generating a corresponding vaporizer device temperature signal, as shown at block 100. The temperature of the fuel vaporizer device may be sensed directly or estimated based on a transient heat transfer model, as described below.

Next, an amount of energy entering the fuel vaporizer device is determined, as shown at block 110. That energy is determined as described above in which the mass rate of air flow into the vaporizer device 54 is sensed, the temperature of the air into the vaporizer device 54 is sensed, the mass of fuel into the vaporizer device 54 is determined, and the temperature of the fuel into the vaporizer device 54 is determined. The amount of energy leaving the fuel vaporizer device 54 is also determined, as shown at block 112. Again, this energy is determined as described above, in which the mass of air flow leaving fuel vaporizer device 54 is determined, the temperature of air leaving vaporizer device 54 is determined, and the temperature of the fuel leaving vaporizer device 54 is determined.

Finally, the air/fuel ratio is estimated based on the vaporizer device temperature signal, the amount of energy entering fuel vaporizer device 54, and the amount of energy leaving fuel vaporizer device 54, as shown at block 114. Air/fuel ratio is determined by dividing the mass of air flow into fuel vaporizer device 54 by the mass of fuel vaporized by fuel vaporizer device 54. Thus, the $\dot{m}_{fuel\text{-}vaporized}$ must be determined first based on the amount of energy entering fuel vaporizer device 54, the amount of energy leaving fuel vaporizer device 54, and the temperature of fuel vaporizer device 54, as described above. Finally, the engine can then be controlled based on the estimated air/fuel ratio, as shown at block 116, without the use of additional costly sensors.

Thus, the present invention allows for the estimation and control of air/fuel ratio during normally "open loop" mode. This is accomplished utilizing sensors presently available on an engine without having to use additional costly sensors.

While the best modes for carrying out the invention have been described in detail, those familiar with the art to which this invention relates will recognize various alternative designs and embodiments for practicing the invention as defined by the following claims.

What is claimed is:

1. A method for estimating air/fuel ratio of an internal combustion engine having an unheated fuel vaporizer device, the method comprising:

determining a temperature of the fuel vaporizer device, determining a mass rate of air entering the fuel vaporizer device;

determining a mass rate of fuel vaporized by the fuel vaporizer based on the temperature of the fuel vaporizer device and the mass rate of air entering the fuel vaporizer device; and estimating the air/fuel ratio based on the mass rate of air entering the fuel vaporizer device and the mass rate of fuel vaporized by the fuel vaporizer.

2. The method as recited in claim 1 further comprising controlling the engine based on the estimated air/fuel ratio.

3. The method as recited in claim 1 wherein determining the mass rate of fuel further includes:

sensing a temperature of air entering the fuel vaporizer device;

determining a mass rate of fuel entering the fuel vaporizer device; and determining a temperature of fuel entering the engine.

4. The method as recited in claim 3 wherein determining the mass rate of air further includes sensing a temperature of air leaving the fuel vaporizer device.

5. The method as recited in claim 1 wherein determining the temperature of the fuel vaporizer device comprises:

determining an initial temperature at an inlet of the fuel vaporizer device;

sensing a temperature of air leaving the fuel vaporizer device; and determining an internal surface area of the fuel vaporizer device.

6. The method as recited in claim 5 wherein determining the initial temperature includes determining an ambient temperature.

7. The method as recited in claim 5 wherein determining the initial temperature includes determining an engine coolant temperature.

8. A system for estimating air/fuel ratio of an internal combustion engine having an unheated fuel vaporizer device, the system comprising:

means for determining a temperature of the fuel vaporizer device;

a sensor for determining a mass rate of air entering the fuel vaporizer device; and control logic, in communication with the engine, operative to determine a mass rate of fuel vaporized by the fuel vaporizer device based on the temperature of the fuel vaporizer device and the mass rate of air entering the fuel vaporizer device, the control logic being further operative to estimate the air/fuel ratio based on the mass rate of air and the mass rate of fuel.

9. The system as recited in claim 8 wherein the control logic is further operative to control the engine based on the estimated air/fuel ratio.

10. The system as recited in claim 8 wherein the control logic, in determining the mass rate of fuel, is further operative to determine a mass rate of fuel entering the fuel vaporizer device and determine a temperature of fuel entering the engine, and the system further comprising:

a second sensor sensing a temperature of air entering the fuel vaporizer device.

11. The system as recited in claim 10 further comprising:

a second sensor for sensing a temperature of air leaving the fuel vaporizer device.

12. The system as recited in claim 8 wherein the control logic, in determining the temperature of the fuel vaporizer device, is further operative to determine an initial temperature at an inlet of the fuel vaporizer device, determine a temperature of air leaving the fuel vaporizer device, and determine an internal surface area of the fuel vaporizer device.

13. The system as recited in claim 12 wherein the control logic, in determining the initial temperature, is further operative to determine an ambient temperature.

14. The system as recited in claim 12 wherein the control logic, in determining the initial temperature, is further operative to determine an engine coolant temperature.

* * * * *